US009181808B2

(12) United States Patent
Carter et al.

(10) Patent No.: US 9,181,808 B2
(45) Date of Patent: Nov. 10, 2015

(54) BLADE OR VANE FOR A TURBOMACHINE

(75) Inventors: Dave Carter, Licoln (GB); Christer Hjalmarsson, Finspong (SE); Kevin Scott, Branston (GB); Lieke Wang, Svaertinge (SE)

(73) Assignee: SIEMENS AKTIENGESELLSCHAFT, München (DE)

( * ) Notice: Subject to any disclaimer, the term of this patent is extended or adjusted under 35 U.S.C. 154(b) by 486 days.

(21) Appl. No.: 13/640,774

(22) PCT Filed: Apr. 14, 2011

(86) PCT No.: PCT/EP2011/055907

§ 371 (c)(1),
(2), (4) Date: Oct. 17, 2012

(87) PCT Pub. No.: WO2011/128404

PCT Pub. Date: Oct. 20, 2011

(65) Prior Publication Data

US 2013/0034429 A1 Feb. 7, 2013

(30) Foreign Application Priority Data

Apr. 14, 2010 (EP) ..... 10003948

(51) Int. Cl.
*F01D 5/18* (2006.01)

(52) U.S. Cl.
CPC ..... *F01D 5/187* (2013.01); *F05D 2240/122* (2013.01); *F05D 2240/304* (2013.01); *F05D 2260/2212* (2013.01); *F05D 2260/2214* (2013.01); *F05D 2260/22141* (2013.01)

(58) Field of Classification Search
CPC . F01D 5/187; F01D 25/12; F05D 2260/2212; F05D 2260/22141
USPC ..... 415/115; 416/97 R
See application file for complete search history.

(56) References Cited

U.S. PATENT DOCUMENTS

| | | | | |
|---|---|---|---|---|
| 3,806,274 | A * | 4/1974 | Moore | 416/97 R |
| 4,407,632 | A | 10/1983 | Liang | |
| 4,515,523 | A * | 5/1985 | North et al. | 415/115 |
| 4,775,296 | A * | 10/1988 | Schwarzmann et al. | 416/97 R |
| 5,288,207 | A | 2/1994 | Linask | |
| 6,382,907 | B1 | 5/2002 | Bregman | |
| 7,674,092 | B2 * | 3/2010 | Annerfeldt et al. | 416/97 R |
| 2007/0172354 | A1 | 7/2007 | Annerfeldt | |
| 2010/0068066 | A1 | 3/2010 | Bunker | |

FOREIGN PATENT DOCUMENTS

| | | | |
|---|---|---|---|
| CN | 1441148 | A | 9/2003 |
| CN | 1851239 | A | 10/2006 |
| JP | 07293203 | A * | 11/1995 |

(Continued)

*Primary Examiner* — Ninh H Nguyen

(57) ABSTRACT

A blade or a vane component of a turbomachine includes an inner space between two opposite inner walls of the component, and a plurality of ribs projecting from the two opposite inner wall forming a plurality of channels on each of the two opposite inner walls to guide the cooling fluid towards the trailing edge. The inner space is divided into a leading section towards the leading edge of the component and a trailing section towards the trailing edge of the component. The ribs are arranged in the leading section. A plurality of pin-fins projecting from the two opposite inner walls is arranged in the trailing section in a discrete manner.

12 Claims, 4 Drawing Sheets

(56) References Cited

FOREIGN PATENT DOCUMENTS

| | | | | |
|---|---|---|---|---|
| RU | 1228559 | A1 | | 10/1996 |
| RU | 2101513 | C1 | * | 1/1998 |
| RU | 2122123 | C1 | | 11/1998 |
| SU | 779590 | A1 | | 11/1980 |
| SU | 1042380 | A1 | | 8/1990 |

* cited by examiner

BLADE OR VANE FOR A TURBOMACHINE

CROSS REFERENCE TO RELATED APPLICATIONS

This application is the US National Stage of International Application No. PCT/EP2011/055907 filed Apr. 14, 2011, and claims the benefit thereof. The International Application claims the benefits of European Application No. 10003948.6 EP filed Apr. 14, 2010. All of the applications are incorporated by reference herein in their entirety.

FIELD OF INVENTION

The present invention relates to a blade or vane component for a turbomachine. Such a blade or vane component is known from the US patent application publication no. 2007/0172354A1.

BACKGROUND OF INVENTION

In modern day turbomachines, various components of the turbomachine operate at very high temperatures. These components include the blade or vane component, which are in shape of an aerofoil. The high operating temperatures may melt the vane or the blade component, hence cooling of these components is important. Cooling of these components is generally achieved by passing a cooling fluid that may include air from a compressor of the turbomachine through a core passage way cast into the blade or vane component.

It is known from the US patent application publication no. 2007/0172354A1 to provide cooling for such a component, which includes an inner space defined by two opposite walls. A plurality of first ribs and second ribs project from the two opposite walls to form a plurality of channels to guide the cooling fluid towards the trailing edge of the component. The matrix arrangement of ribs in the blade or vane component helps in feeding the cooling fluid from different directions which provides efficient cooling. However, the matrix arrangement provides a less effective cooling and also leads to reduced flow capacity because of smaller flow area at the trailing edge, which should be as thin as possible to provide better aerodynamic performance. In addition, the matrix arrangement of ribs which involves fine features is difficult to cast due to the thin cross-section at the trailing edge of the component.

SUMMARY OF INVENTION

It is an object to provide a cooling arrangement for a blade or vane component that is easy to cast and provides enhanced cooling at the trailing edge.

The object is achieved by a blade or vane component according to the claims.

The blade or vane component for the turbomachine includes an inner space between two opposite inner walls of the component by forming a passage way for a cooling fluid towards a fluid outlet at the trailing edge of the component. The component includes a plurality of ribs projecting from the two opposite inner walls forming a plurality of channels on each of the two opposite walls to guide the cooling fluid towards the trailing edge, wherein the ribs on the opposite sides are inclined relative to each other to form a matrix arrangement. Further, the inner space is divided into a leading section towards the leading edge of the component and a trailing section towards the trailing edge of the component. The ribs are arranged in the leading section and a plurality of pin-fins projecting from the two opposite walls are arranged in the trailing section in a discrete manner By choosing both the ribs and the pin-fins for different sections within the component an excellent creep and low cycle fatigue performance can be maintained by the matrix arrangement of ribs in combination with an enhanced cooling and better castability of the pin-fins in the trailing section. In addition, the pin-fins enable thinner cross-section of the trailing edge and the discrete arrangement creates turbulence in the way of the cooling fluid at the trailing section thereby enhancing the cooling effect.

An arrangement of pin-fins in two or more rows ensures full coverage of trailing section along the trailing edge of the component. Furthermore, the two or more rows of pin-fins increase the surface area, which forces the cooling fluid to change direction and also increases the impingement surfaces which aid in efficient cooling at the trailing edge.

The component may further comprise an intermediate section between the leading section and the trailing section. The intermediate section includes ribs and pin-fins. The intermediate section thus derives benefits of ribs which are improved creep and low cycle fatigue (LCF) performance as well as the property of pin-fins to allow efficient heat transfer from the component.

By providing a connection between the ribs and the pin-fins in the intermediate section an improved stress solution to the component is achieved. Further, casting of such an arrangement is easy and provides efficient heat transfer due to increase in the flow area which allows more amount of cooling fluid to pass.

A row of pin-fins may be connected to ribs projecting from one of the two opposite inner walls in the intermediate section. The arrangement increases turbulence in the path of cooling fluid and also allows more cooling fluid to pass through thereby providing efficient cooling.

Casting the ribs and the pin-fins into the component ensures high strength of the component and at the same time the volume of inner space may be utilized for the flow of cooling fluid.

Casting the ribs and the pin-fins from a base material of the component is a cheap and cost effective option.

According to a further embodiment of the invention, at least some of the pin-fins connect the two opposite inner walls. By such an arrangement, more turbulence may be created in the path of cooling fluid due to the increase in surface area thereby increasing the cooling effect at the trailing edge. Also, the arrangement increases the mechanical strength of the component.

Advantageously, at least some of the pin-fins extend midway between the two opposite inner walls. Such an arrangement is easy to cast and also creates turbulence in the flow of the cooling fluid for efficient heat transfer.

A trailing section which has an extent of about 10% to about 20% of the distance between the leading edge and the trailing edge offers a good compromise between cooling effectiveness of matrix arrangement, the flow area and practicality of manufacture of the component.

According to another embodiment the pin-fins project in an alternating manner from the two opposite inner walls. Such an arrangement is easy to cast because of the thin cross-section of the trailing edge.

The distance between the pin-fins should be at least equal to diameter of the pin-fins. Pin-fins which are spaced too close to each other weaken the inner walls that may result in breakage during casting. Such an arrangement is easy to cast and also allows proper flow of cooling fluid through the trailing section.

The above-mentioned and other features of the invention will now be addressed with reference to the accompanying drawings of the present invention. The illustrated embodiments are intended to illustrate, but not limit the invention. The drawings contain the following figures, in which like numbers refer to like parts, throughout the description and drawings.

DETAILED DESCRIPTION OF INVENTION

Embodiments of the present invention described below relate to a blade or vane component in a turbomachine. The turbomachine may include a gas turbine, a turbofan and the like.

Cooling of the blade or vane component in a turbomachine is important since the blade or vane operate at very high temperatures. High operating temperatures may cause the blade or vane to melt thereby causing damage to the turbomachine.

Figure 1:
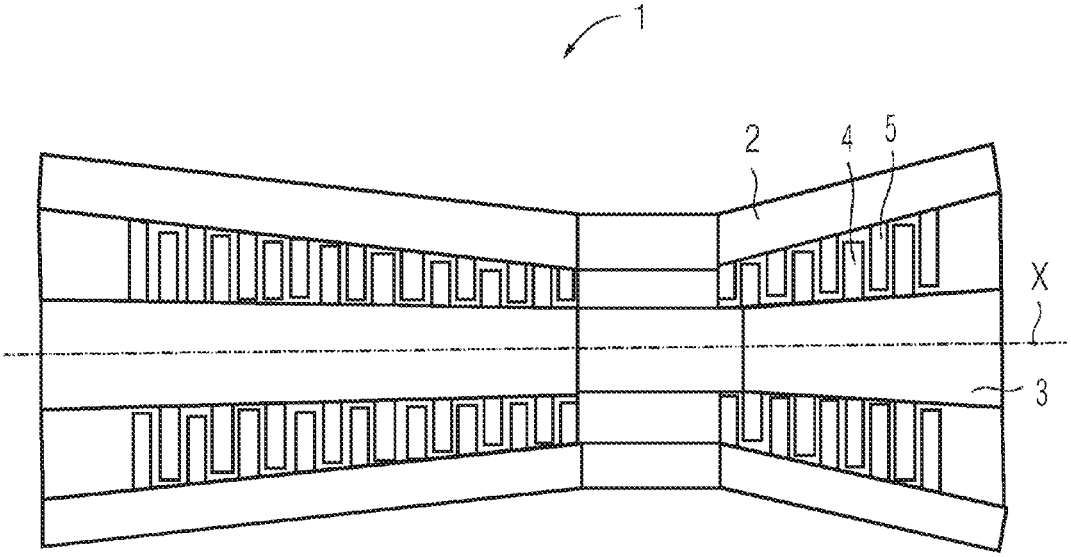
FIG. 1 shows a longitudinal sectional view through a gas turbine.

FIG. 1 discloses schematically a gas turbine 1 having a stationary housing 2 and a rotor 3, which is rotatable in the housing 2 around a rotary axis x. The gas turbine 1 includes a number of rotor blades 4 mounted to the rotor 3 and a number of stationary guide vanes 5 mounted to the housing 2.

Each of the rotor blades 4 and the guide vanes 5 thus forms a component of the gas turbine 1. Although, the following description refers to a component in the form of a rotor blade 4, it should be noted that the invention is also applicable to the guide vane 5 and that the characteristic features to be described in the following may also be included in a stationary guide vane 5. The component will be described with reference to the rotor blade 4, more closely in FIGS. 2 and 3.

Figure 2:
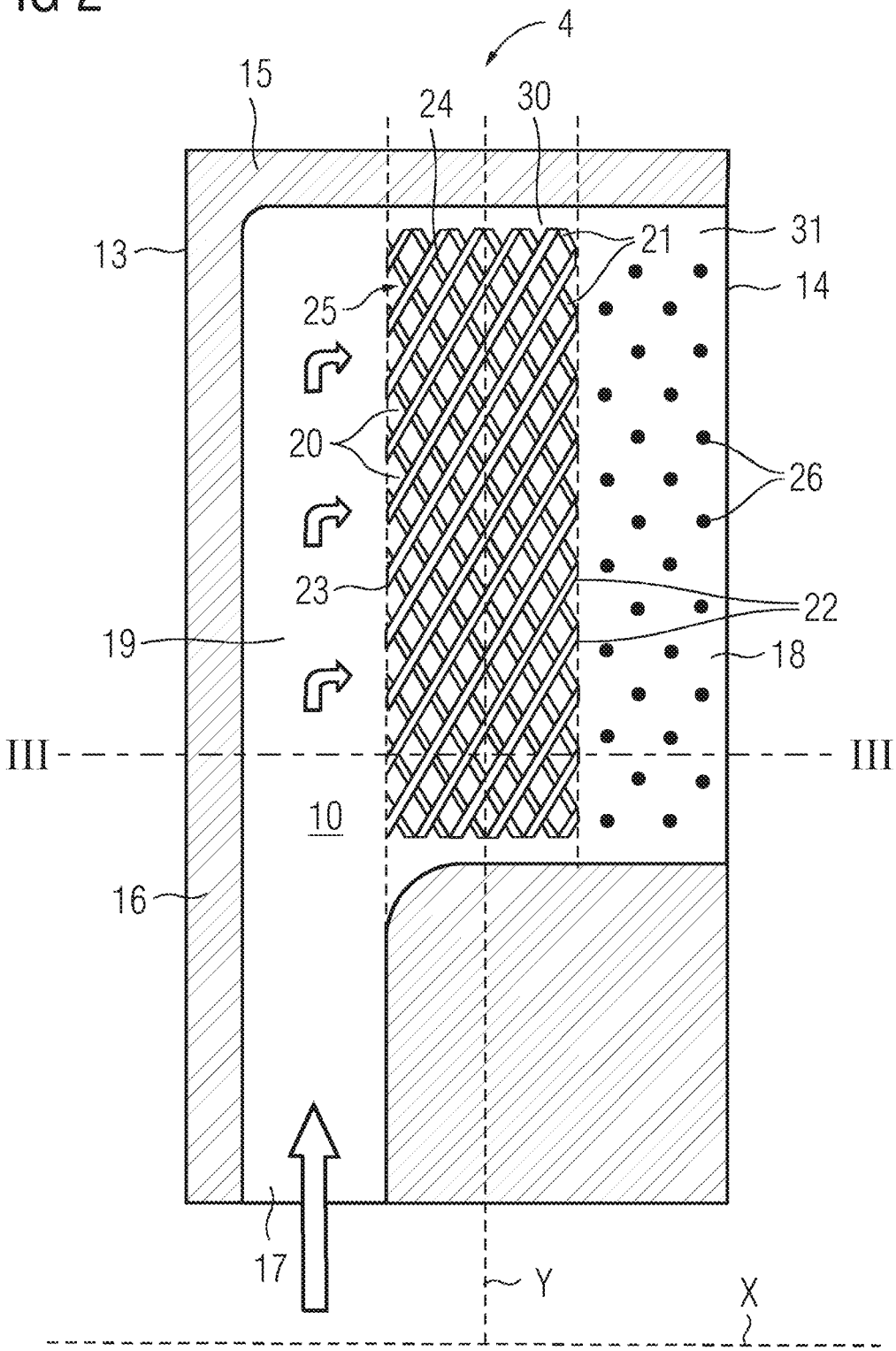
FIG. 2 shows an axial sectional view through an exemplary rotor blade of the gas turbine.
Figure 3:
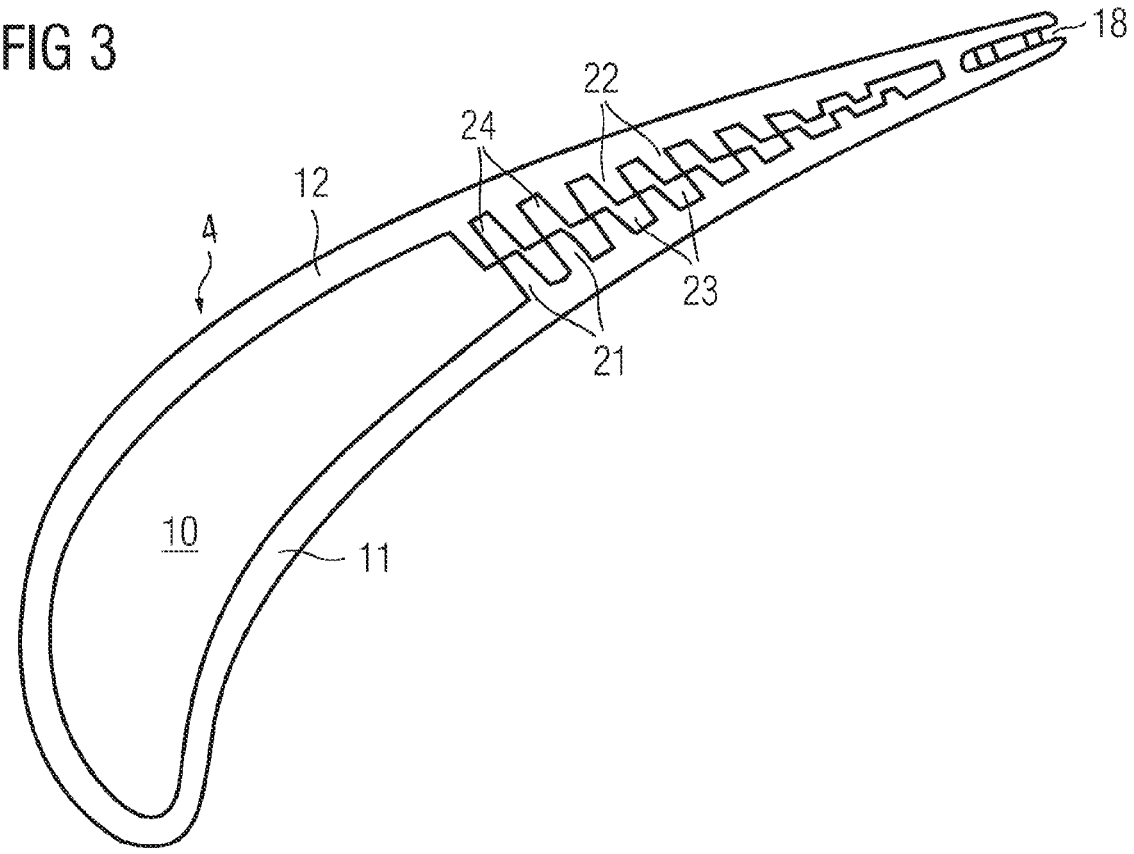
FIG. 3 shows a cross-sectional view through the rotor blade along the lines III-III in FIG. 2.

FIG. 2 shows an axial sectional view of the rotor blade 4 and FIG. 3 shows a cross-sectional view through the rotor blade 4 along the lines III-III in FIG. 2. The rotor blade 4 includes an inner space 10, which is limited by two opposite inner walls 11, 12. More particularly, the inner space 10 is limited by a first wall 11 and a second wall 12. The first wall 11 and the second wall 12 face each other. The first wall 11 is provided at the pressure side of the rotor blade 4 whereas the second wall 12 is provided at the suction side of the rotor blade 4. Furthermore, the rotor blade 4 has a leading edge 13, a trailing edge 14, a top portion 15 and a bottom portion 16. The bottom portion 16 forms the root of the rotor blade 4. The rotor blade 4 is mounted to the body of the rotor 3 in such a way that the root is attached to the body of the rotor 3 whereas the top portion 15 is located at the radially outermost position of the rotor 3. The rotor blade 4 extends along a centre axis y extending through the rotor 3 from the bottom portion 16 to the top portion 15 substantially in parallel with the leading edge 13 and the trailing edge 14. The centre axis y is substantially perpendicular to the rotary axis x.

In accordance with aspects of the present technique, the inner space 10 is divided into a leading section 30 and a trailing section 31. The leading section 30 is located towards the leading edge 13 of the rotor blade 4 and a trailing section 31 is located towards the trailing edge 14 of the rotor blade 4. The trailing section 31 may have an extent of about 10% to about 20% of the distance between the leading edge 13 and the trailing edge 14 of the rotor blade 4.

Furthermore, the rotor blade 4 has an inlet 17 to the inner space 10 and an outlet 18 from the inner space 10. The inlet 17 is provided at the bottom portion 16 and the outlet 18 at the trailing edge 14. The inner space 10 thus forms a passage for a cooling fluid from the inlet 17 to the outlet 18. The inner space 10 extends in a substantially radial direction with respect to the rotary axis x and in parallel with the centre axis y from the bottom portion 16 to the top portion 15. The inner space 10 includes a distribution chamber 19 and a plurality of ribs projecting from the two opposite inner walls, that is, the first wall 11 and the second wall 12. The plurality of ribs 21, 22 form a plurality of channels 20 in a form of matrix 25 on the two opposite inner walls 11, 12. The distribution chamber 19 is positioned inside and in the proximity of the leading edge 13 and extends from the inlet 17 in parallel to the centre axis y. The plurality of channels 20 are configured to guide the cooling fluid towards the trailing edge 14. It may also be noted that the plurality of channels 20 extend from the bottom portion 16 to the top portion 15 of the rotor blade 4.

More particularly, the plurality of channels 20 of the rotor blade 4 is formed by a plurality of ribs 21, 22. The cooling fluid may include compressed air from a compressor of the gas turbine 1 (see FIG. 1). Additionally the cooling fluid may include a cooling liquid such as oil or a coolant which flows inside the blade 4 or the guide vane 5.

In accordance with aspect of the present technique, the plurality of ribs 21, 22 include a set of first ribs 21 projecting from the first wall 11 and a set of second ribs 22 projecting from the second wall 12. The set of first ribs 11 extend substantially parallel to each other to form first channels 23 for the flow of the cooling fluid in the leading section. Similarly, the set of second ribs 22 extend substantially parallel to each other to form second channels 24 for the flow of the cooling fluid in the leading section 30 towards the trailing section 31.

It may be noted that the blade 4 or the vane 5 for a turbomachine may suffer from creep and low cycle fatigue performance which results in fracture and structural damage to the blade 4 or the vane 5. The matrix 25 arrangement of ribs 21, 22 in the present invention ensures improved creep and low cycle fatigue performance thereby increasing the life of the blade 4 or the vane 5.

Also, in accordance with aspects of the present technique, the rotor blade 4 includes a plurality of pin-fins 26. The pin-fins 26 project from the first wall 11 and the second wall 12. These pin-fins 26 are present in the trailing section 31 of the inner space 10 towards the trailing edge 14 of the rotor blade 4. The pin-fins 26 provide excellent cooling and are also easy to cast, especially at the region in the rotor blade 4 where the cross-section is thin such as the trailing edge 14.

In one embodiment, the pin-fins 26 are arranged in two or more rows along the trailing edge 14 of the blade 4. Also, the pin-fins 26 are present from the top portion 15 to the bottom portion 16 of the blade 4. The pin-fins 26 are arranged in a discrete manner in the trailing section 31. As used herein the term 'discrete' means separate from each other. The pin-fins 26 are arranged such that the distance between two pin-fins 26 is at least equal to the diameter of the pin-fins 26. In an exemplary embodiment the distance between two pin-fins 26 is about one and a half times the diameter of the pin-fins 26.

With continuing reference to FIG. 2, the plurality of ribs 21, 22 that is the set of first ribs 21 and the set of second ribs 22 projecting from the first wall 11 and the second wall 12 respectively are inclined relative to each other in a manner that they form a matrix 25 arrangement as depicted in FIG. 2. More particularly, the plurality of ribs 21, 22 when viewed from the direction of the rotational movement around the rotary axis x form the matrix 25 arrangement.

Furthermore, in accordance with the aspects of the present technique, the pin-fins 26 and the ribs 21, 22 are cast into the rotor blade 4. More particularly, the pin-fins 26 and the ribs 21, 22 are cast from the base material of the rotor blade 4.

As depicted in FIG. 3, the matrix 25 arrangement of the ribs 21, 22 is present in the leading section 30 and the pin-fins 26 are arranged in the trailing section 31 of the blade 4. The pin-fins 26 are shown as connecting the two opposite inner walls 11, 12, that is, the first wall 11 and the second wall 12. In one embodiment, the pin-fins 26 may extend mid-way between the first wall 11 and the second wall 12. In another embodiment the pin fins 26 may project from the first wall 11 and the second wall 12 in an alternating manner. It may be noted that various other arrangements of the pin-fins 26 may also be provided based on the requirements and ease of casting.

Figure 4:
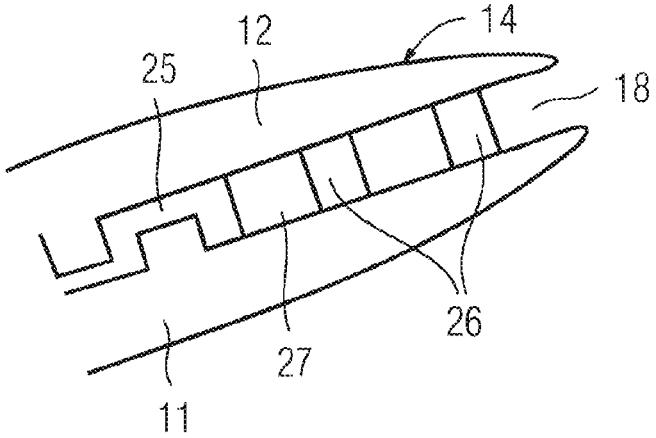
FIG. 4 shows a blown-up view of the trailing edge of the rotor blade as depicted in FIG. 3.

FIG. 4 is a blown-up view of the trailing edge 14 of the rotor blade 4. As depicted, pin-fins 26 are shown as connecting the first wall 11 and the second wall 12. Further, the matrix 25 arrangement of the plurality of channels 20 formed by the ribs 21, 22 end at the start of the trailing section 31. In the presently contemplated configuration, a gap 27 is depicted as separating the plurality of ribs 21, 22 with the pin-fins 26. The gap 27 enables a uniform distribution of flow of the cooling fluid.

Figure 5:
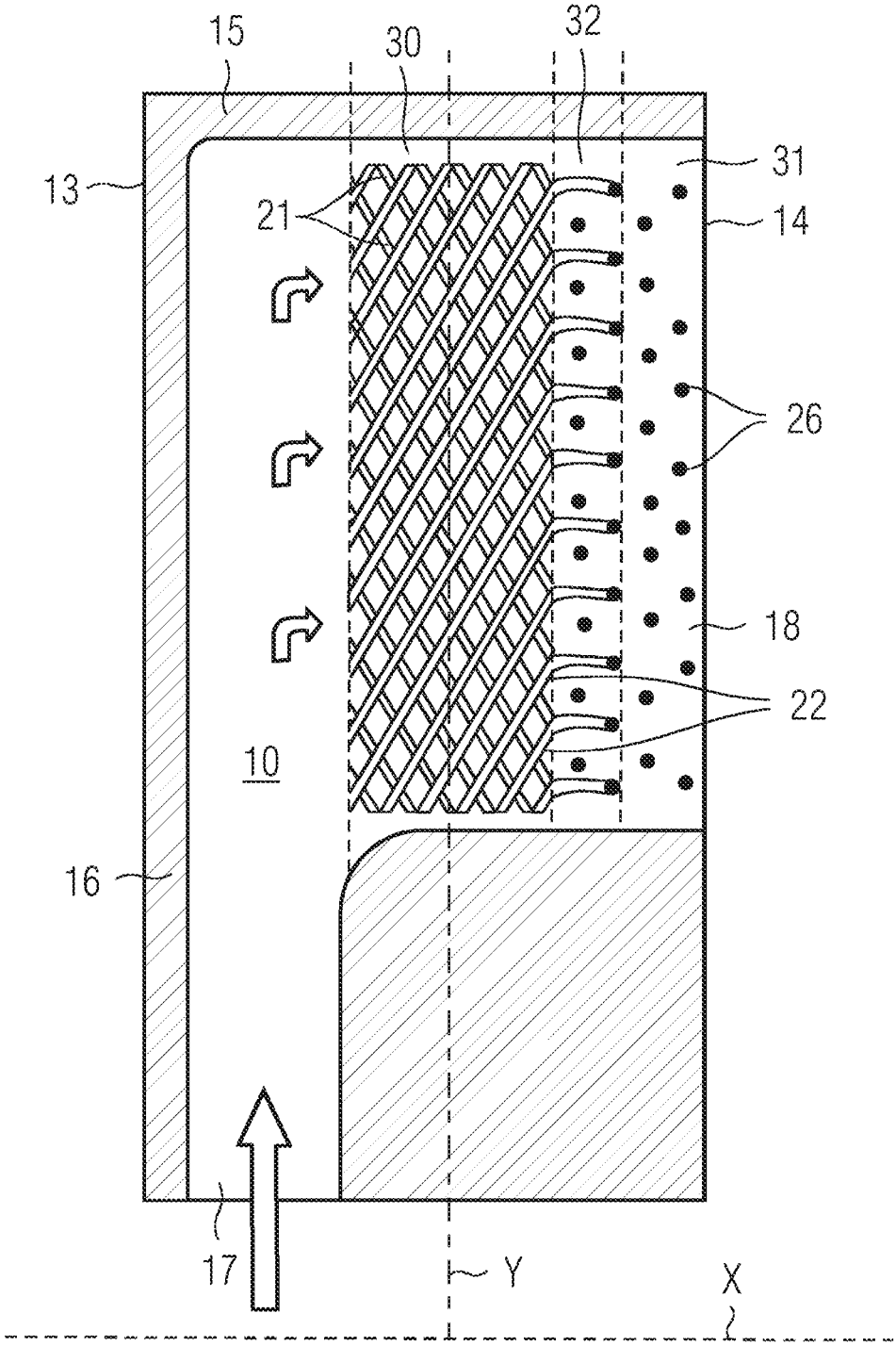
FIG. 5 shows another embodiment of the rotor blade of FIG. 2.

FIG. 5 is a sectional view of the blade 4 according to another embodiment of the present invention. As illustrated in FIG. 5, the inner space 10 includes an intermediate section 32 between the leading section 30 and the trailing section 31. The intermediate section 32 includes the ribs 21, 22 which project from the two opposite inner walls 11, 12 coming from the leading section 30. The intermediate section 32 also includes pin-fins 26 arranged in two or more rows. The ribs 21, 22 are connected to a row of pin-fins 26 in the intermediate section 32. More particularly, the ribs 21, 22 are connected to a row of pin fins 26 in the intermediate section 32 which is towards the trailing section 31. Alternatively, in one embodiment, the set of first ribs 21 may be connected to the row of pin-fins 26. In another embodiment, the set of second ribs 22 may be connected to the row of pin fins 26.

The invention claimed is:

1. A blade or vane component of a turbomachine, comprising:

an inner space between two opposite inner walls of the component forming a passage way for a cooling fluid towards a fluid outlet at the trailing edge of the component, a plurality of ribs projecting from the two opposite inner walls forming a plurality of channels on each of the two opposite inner walls to guide the cooling fluid towards the trailing edge, wherein the ribs on the opposite sides are inclined relative to each other to form a matrix arrangement, wherein the plurality of channels on the two opposite inner walls fluidically intersect with each other in the matrix arrangement, wherein the inner space is divided into a leading section towards a leading edge of the component and a trailing section towards the trailing edge of the component, wherein the ribs are arranged in the leading section, wherein the component further comprises a plurality of pin-fins projecting from the two opposite inner walls arranged in the trailing section in a discrete manner, wherein the component further comprises an intermediate section between the leading section and the trailing section, wherein the intermediate section comprises ribs and pin-fins, and wherein the ribs are connected to at least some of the pin-fins in the intermediate section.

2. The component according to claim 1, wherein the plurality of pin-fins are arranged in two or more rows such that the two or more rows are in the direction of the trailing edge.

3. The component according to claim 1, further comprising:

at least two rows of the pin-fins in the intermediate section in direction towards the trailing edge, wherein the ribs are connected to a row of the pin-fins arranged towards the trailing section.

4. The component according to claim 1, wherein the ribs and the pin-fins are cast into the component.

5. The component according to claim 4, wherein the ribs and the pin-fins are cast from a base material of the component.

6. The component according to claim 1, wherein at least some of the pin-fins connect the two opposite inner walls.

7. The component according to claim 1, further comprising a distribution chamber at the leading section for distributing the cooling fluid to all the plurality of channels.

8. The component according to claim 1, wherein the trailing section has an extent of about 10% to about 20% of the distance between the leading edge and the trailing edge.

9. The component according to claim 1, wherein a distance between the pin-fins is at least equal to a diameter of the pin-fins.

10. The component according to claim 1, wherein the pin-fins and the plurality of ribs are separated by a gap.

11. A blade or vane component of a turbomachine, comprising:

an inner space between two opposite inner walls of the component forming a passage way for a cooling fluid towards a fluid outlet at the trailing edge of the component, a plurality of ribs projecting from the two opposite inner walls forming a plurality of channels on each of the two opposite inner walls to guide the cooling fluid towards the trailing edge, wherein the ribs on the opposite sides are inclined relative to each other to form a matrix arrangement, wherein the plurality of channels on the two opposite inner walls fluidically intersect with each other in the matrix arrangement, wherein the inner space is divided into a leading section towards a leading edge of the component and a trailing section towards the trailing edge of the component, wherein the ribs are arranged in the leading section, and wherein the component further comprises a plurality of pin-fins projecting from the two opposite inner walls arranged in the trailing section in a discrete manner, and wherein at least some of the pin-fins extend midway between the two opposite inner walls.

12. A blade or vane component of a turbomachine, comprising:

an inner space between two opposite inner walls of the component forming a passage way for a cooling fluid towards a fluid outlet at the trailing edge of the component, a plurality of ribs projecting from the two opposite inner walls forming a plurality of channels on each of the two opposite inner walls to guide the cooling fluid towards the trailing edge, wherein the ribs on the opposite sides are inclined relative to each other to form a matrix arrangement, wherein the plurality of channels on the two opposite inner walls fluidically intersect with each other in the matrix arrangement, wherein the inner space is divided into a leading section towards a leading edge of the component and a trailing section towards the trailing edge of the component, wherein the ribs are arranged in the leading section, and wherein the component further comprises a plurality of pin-fins projecting from the two opposite inner walls arranged in the trailing section in a discrete manner, and wherein the pin-fins project in an alternating manner from the two opposite inner walls.

* * * * *